US005673871A

United States Patent [19]

Wrase

[11] Patent Number: 5,673,871

[45] Date of Patent: Oct. 7, 1997

[54] LUBRICATING DEVICE FOR AN EXPANDING REEL MANDREL

[75] Inventor: Peter Wrase, Dormagen, Germany

[73] Assignee: Mannesmann Aktiengesellschaft, Düsseldorf, Germany

[21] Appl. No.: 587,366

[22] Filed: Jan. 16, 1996

[30] Foreign Application Priority Data

Jan. 12, 1995 [DE] Germany ..... 195 02 040.5

[51] Int. Cl.[6] ..... B65H 75/24

[52] U.S. Cl. ..... 242/573.2; 242/914

[58] Field of Search ..... 242/573, 573.1, 242/573.2, 573.3, 573.4, 573.5, 573.6, 573.7, 573.8, 573.9, 575.3, 575.4, 914; 279/2.11, 2.12, 2.13, 2.14, 2.15, 2.16; 269/48.1

[56] References Cited

U.S. PATENT DOCUMENTS

| | | | |
|---|---|---|---|
| 2,483,144 | 9/1949 | McConnell et al. | 242/573.8 |
| 2,578,953 | 12/1951 | Tyrrell | 242/573.7 |
| 3,754,720 | 8/1973 | Gross et al. | 242/914 |
| 4,105,171 | 8/1978 | Sciola et al. | 242/914 |

FOREIGN PATENT DOCUMENTS

| | | | |
|---|---|---|---|
| 0002652 | 7/1979 | European Pat. Off. . | |
| 2032542 | 1/1971 | Germany . | |
| 5116846 | 5/1993 | Japan | 242/914 |

*Primary Examiner*—John M. Jillions
*Attorney, Agent, or Firm*—Cohen, Pontani, Lieberman & Pavane

[57] ABSTRACT

A lubricating apparatus for centrally distributing lubricant to a desired lubrication point of a wedge surface of an expanding reel mandrel through an axial bore defined in the shaft of an expanding reel mandrel. The mandrel further defines a channel therein for establishing fluid communication between the lubrication point and the axial bore of the mandrel shaft. One or more lubricant-guiding cartridges are disposed within the axial bore of the mandrel shaft and a central lubricant distribution unit is attached to an end of the shaft for distributing lubricant to the cartridges. Each cartridge has a longitudinal conduit defined therein and a peripheral wall having an annular transverse groove. The transverse groove is in fluid communication with the longitudinal conduit and with the channel so that lubricant is flowable from the central distribution unit to the lubrication point on the wedge surface.

5 Claims, 1 Drawing Sheet

LUBRICATING DEVICE FOR AN EXPANDING REEL MANDREL

BACKGROUND OF THE INVENTION

1. Field of the Invention

The invention is directed to a lubricating apparatus for lubricating an expanding reel mandrel and, in particular, to a lubricating apparatus for centrally distributing a lubricant to predetermined locations on a wedge surface of an expanding reel mandrel which is intended to accommodate rolled strip material.

2. Description of the Prior Art

A reel mandrel having a lubricating device is disclosed, by way of example, in German Publication 20 32 542 Al; other reel mandrels of this type are described in European patent application No. 00 02 652. These mandrels are of the expanding type, a design that permits ready removal of wound coils of sheet metal from the reel shaft or the placement thereon of a coil for unwinding of the coil. A typical expanding reel mandrel includes expansion segments movably supported on expandable wedge surfaces that are movably secured to the reel shaft. During an expansion phase or operation, the wedge surfaces are displaced relative to the expansion segments such that the latter move radially inward or outward with respect to the shaft, and various mechanical drive systems for expanding the wedge surfaces are known in the art. However, these prior art systems have a common problem—they provide inadequate lubrication to the sliding surfaces as the surfaces are forcibly pressed against each other. The number of lubricating points on a given mandrel is a function of the number of wedge surfaces on the reel mandrel.

These lubricating points require frequent lubrication and are typically furnished with manual lubricating nipples. Thus, with an average of 50 lubricating points to a mandrel, the task of manually lubricating the reel mandrel becomes an expensive and time consuming maintenance activity. Also, manually servicing each lubricating nipple requires lengthy shutdown of the installation and, therefore, loss of valuable production time. Furthermore, poor accessibility of the lubricating points on the reel mandrel increases the likelihood of accidents involving maintenance personnel. In addition, individual lubricating points may be inadvertently overlooked or forgotten by maintenance personnel, which may result in damage to the sliding surfaces and/or malfunctioning of the reel.

OBJECTS AND SUMMARY OF THE INVENTION

An object of the present invention is thus to provide an apparatus which minimizes the time required to lubricate an expanding reel mandrel and reduces idle time of the mandrel while reducing the likelihood of accidents associated with such maintenance activity.

Another object of the present invention is to provide a lubricating apparatus for continuously or selectively supplying lubricant to all lubricating areas defined on wedge surfaces of an expanding reel mandrel.

Still another object of the invention is to provide a lubricating apparatus which is adjustable to selectively vary the amount of lubricant supplied to each lubricating area defined on a wedge surface of an expanding reel mandrel.

In one embodiment of the present invention, the lubricating apparatus for centrally distributing lubricant to a plurality of lubrication points defined in a wedge surface of an expanding reel mandrel through an axial bore defined in and through a shaft of the expanding reel mandrel, the mandrel having a plurality of channels each disposed for establishing fluid communication between the one of the plural lubrication points and the axial bore, includes a lubricant-guiding cartridge disposable within the axial bore of the mandrel shaft. The cartridge has a plurality of longitudinal conduits defined therein for communicating lubricant along the longitudinal conduits and a plurality of transverse grooves defined in the cartridge and each aligned in fluid communication with one of the plural conduits and one of the plural channels for communicating lubricant from said one conduit to said each transverse groove to said one channel for lubricating one of the plural lubrication points of the mandrel. The apparatus, in addition, includes a central lubricant distribution unit in fluid communication with the plural longitudinal conduits in the cartridge for feeding lubricant from the distribution unit to the lubrication points through the plural conduits, transverse grooves and channels.

In another embodiment, the cartridge of the lubricating apparatus further comprises a peripheral wall, and the transverse grooves include annular grooves defined in and about the peripheral wall substantially transverse to the longitudinal conduits.

In still another embodiment, the cartridge also includes a peripheral wall and a sealing mechanism, disposed proximate the peripheral wall between adjacent ones of the transverse grooves, for sealing against cross-flow of lubricant between the adjacent grooves. The central lubricant distribution unit further includes a mechanism for adjusting an amount of lubricant supplied to each conduit and a mechanism for automatically coupling the unit to a lubricant supply.

In accordance with one aspect of the present invention, a centrally-lubricating expanding reel mandrel includes a mandrel shaft defining a longitudinal axis and having an axial bore defined longitudinally therein and bounded by an inner wall of the shaft. The shaft has a wedge surface supported thereon and the wedge surface has a lubrication point defined therein. The shaft defines a channel for establishing fluid communication between the lubrication point of the wedge surface and the axial bore of the shaft. The mandrel further includes a lubricant-guiding cartridge disposed within the mandrel shaft bore, the cartridge having a longitudinal conduit defined in and through the cartridge and a peripheral wall having a circumferentially annular transverse groove defined in the peripheral wall in fluid communication with the longitudinal conduit for lubricant flow from the conduit to the annular groove. The annular groove is further defined in fluid communication with the channel in the shaft for lubricant flow from the annular groove to the lubrication point through the channel. The mandrel still further includes a central lubricant distribution unit at an end of the shaft proximate the cartridge and in fluid communication with the longitudinal conduit of the cartridge for centrally distributing lubricant from the unit through the conduit to the lubrication point.

In accordance with another aspect of the present invention, the peripheral wall of the cartridge further defines a second annular transverse groove disposed adjacent the annular groove. The mandrel further includes a sealing mechanism disposed along and between edges of the adjacent annular grooves for sealing engagement with the inner wall of the shaft so as to prevent cross-flow of lubricant between the adjacent annular grooves.

In accordance with still another aspect of the present invention, the central lubricant distribution unit includes a mechanism for adjusting an amount of lubricant supplied to the lubrication point.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. Moreover, the drawings are not drawn to scale and, as such, are merely conceptual in disclosing the preferred embodiments of the invention.

BRIEF DESCRIPTION OF THE DRAWINGS

In the drawings, wherein like reference characters denote similar elements throughout the several views.

DETAILED DESCRIPTION OF THE PRESENTLY PREFERRED EMBODIMENTS

Figure 1:
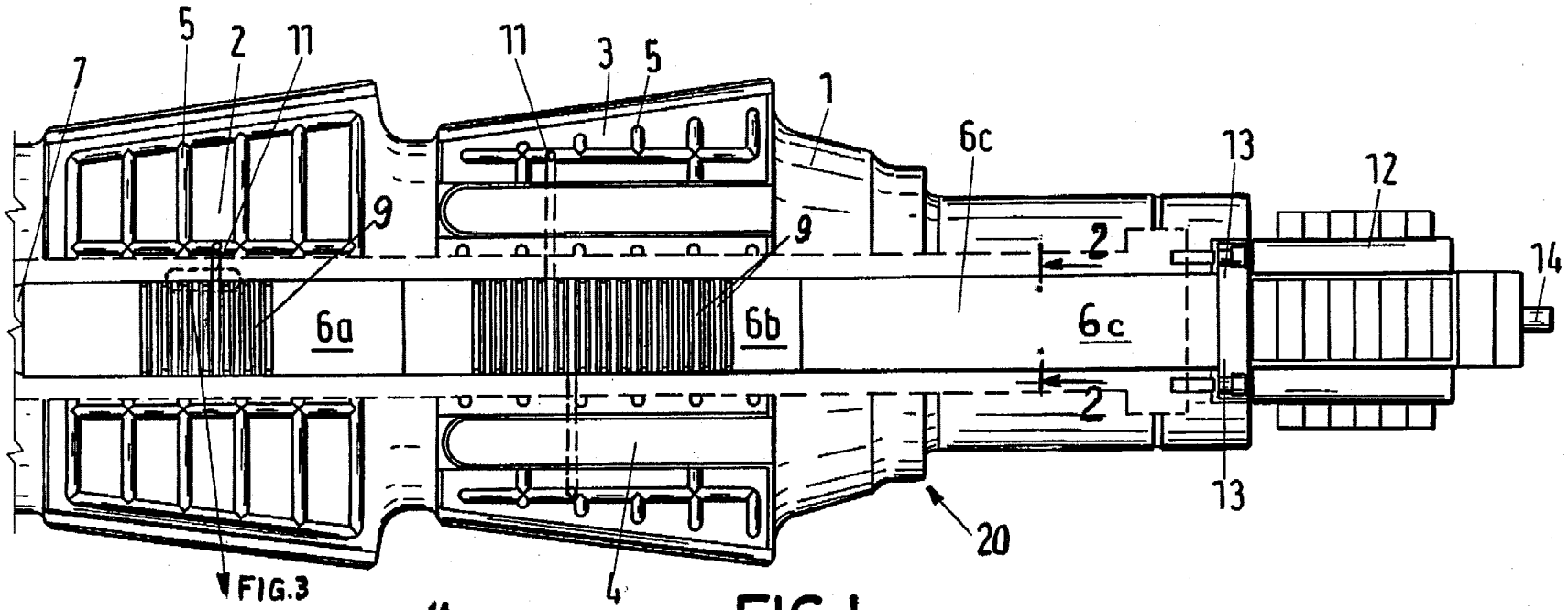
FIG. 1 is a partial sectional view of an expanding reel mandrel including a preferred embodiment of a lubricating apparatus constructed in accordance with the present invention.

FIG. 1 depicts a truncated section of a mandrel shaft 1 of an expanding reel mandrel including on its circumference, by way of example, a plurality of wedge surfaces 2, 3 arranged one following another along a longitudinal axis of the shaft 1. Movably supported on the wedge surfaces 2, 3 are expansion segments (not shown) which are slidingly guided and held against centrifugal forces in the groove 4. The wedge surfaces 2, 3 are further provided with a network of lubricating points or areas 5 to which it is necessary to apply a lubricant. Also depicted in FIG. 1 is a central bore 7 defined axially within and longitudinally along the mandrel shaft 1.

The inventive lubricating apparatus 20 includes lubricant-guiding cartridges such as, for example, as the tripartite cartridge *6a, 6b, 6c* disposed within and extending along the axial bore 7 for guiding lubricant therethrough, and a central lubricant distribution unit 12 secured to an end 13 of the mandrel shaft 1 upstream of and communicating with the cartridges *6a, 6b, 6c* for feeding and distributing lubricant thereto.

Figure 2:
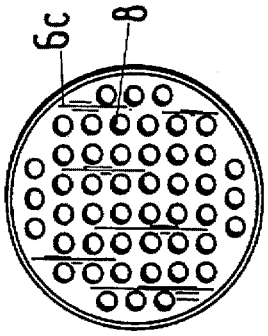
FIG. 2 is a cross-sectional view taken along the lines 2—2 in FIG. 1.
Figure 3:
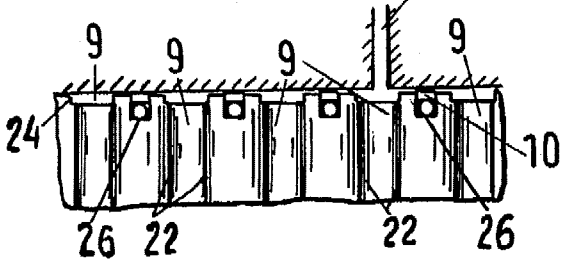
FIG. 3 is an enlarged cross-sectional view of a portion of the lubricating apparatus shown in FIG. 1.

As can be seen in the cross-sectional view in FIG. 2, each of the cartridges or cartridge sections *6a, 6b, 6c* is preferably cylindrical in shape (or otherwise peripherally conform to the cross-sectional shape of the central bore 7) and has a plurality of longitudinal conduits 8 defined therein. The cartridges or cartridge sections are aligned in end-to-end relation so that each longitudinal conduit 8 of each cartridge is in fluid communication with a corresponding cartridge conduit 8 disposed upstream and/or downstream thereof to define a continuous lubricant path. Defined circumferentially on an outer surface of each cartridge or cartridge section *6a, 6b* are a plurality of annular transverse grooves 9, each groove 9 being in fluid communication with a preselected conduit 8 of a cartridge or cartridge section *6a, 6b, 6e* (see FIG. 3). Cartridge section *6e* has no annular transverse grooves 9 on its circumference since, in the particular embodiment herein disclosed, it merely serves to guide or convey lubricant to downstream cartridge sections *6b* and *6c* (see FIG. 1).

To guide lubricant from the grooves 9 to the respective lubrication points or areas 5, there are defined in the mandrel shaft 1 a corresponding plurality of channels 11 for guiding lubricant from a preselected groove 9 to a corresponding preselected lubricating area 5 on a wedge surface 2 or 3. Preferably, annular seals 10 are arranged between the edges 22 of adjacent annular transverse grooves 9 for sealing engagement with the inner peripheral wall 24 bounding and defining the axial bore 7 of the mandrel shaft 1 so that lubricant is not permitted to cross-flow from one to an adjacent groove 9. The annular seal 10 may, for example, be received in an annular recess 26 or otherwise captured between the adjacent edges 22 of adjacent annular transverse grooves 9.

A central grease distribution unit 12 may also be provided and, for example, supportedly attached to an end 13 of the mandrel shaft 1 such that lubricant supplied to or flowing into the distribution unit 12 may be dispensed, uniformly or otherwise, to each of the longitudinal conduits 8 of the cartridge sections *6a, 6b, 6c*. The distribution unit 12 may include a mechanism for adjusting or varying the amount of lubricant that is supplied to the lubricating points or areas 5. An automatic coupling mechanism may also be associated with the distribution unit 12 for automatically coupling, regulating and/or metering the quantity of lubricant fed from a supply line 14 to the central distribution unit 12 so that the entire process of lubricating the reel mandrel can be automated.

In operation, a user, at a desired interval, causes a quantity of lubricant to be supplied to the central distribution unit 12 for allocation among and distribution through the plurality of longitudinal conduits 8 of the cartridge sections *6a, 6b, 6c*. From these conduits 8, the lubricant flows into the annular transverse grooves 9, through the corresponding channels 11, and into each preselected lubricating point or area 5 on wedge surfaces 2, 3.

While there have been shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A lubricating apparatus for centrally distributing lubricant to a plurality of lubrication points defined in a wedge surface of an expanding reel mandrel through an axial bore defined in and through a shaft of the expanding reel mandrel, said mandrel having a plurality of channels each disposed for establishing fluid communication between the one of the plural lubrication points and the axial bore, comprising:

a lubricant-guiding cartridge disposable within the axial bore of the mandrel shaft and having a plurality of longitudinal conduits defined therein for communicating lubricant along said longitudinal conduits, and a plurality of transverse grooves defined in said cartridge and each aligned in fluid communication with one of said plural conduits and one of said plural channels for communicating lubricant from said one conduit to said each transverse groove to said one channel for lubricating one of said plural lubrication points of the mandrel; and a central lubricant distribution unit in fluid communication with said plural longitudinal conduits in said cartridge for feeding lubricant from said distribution unit to said lubrication points through said plural conduits, transverse grooves and channels.

2. The lubricating apparatus of claim 1, wherein said cartridge further comprises a peripheral wall and said transverse grooves comprise annular grooves defined in and about said peripheral wall substantially transverse to said longitudinal conduits.

3. The lubricating apparatus of claim 1, wherein said cartridge further comprises a peripheral wall and sealing means, disposed proximate said peripheral wall between adjacent ones of said transverse grooves, for sealing against cross-flow of lubricant between said adjacent grooves.

4. A centrally-lubricating expanding reel mandrel, comprising:

a mandrel shaft defining a longitudinal axis and having an axial bore defined longitudinally therein and bounded by an inner wall of the shaft, said shaft having a wedge surface supported thereon and said wedge surface having a lubrication point defined therein, and said shaft defining a channel for establishing fluid communication between said lubrication point of said wedge surface and said axial bore of said shaft;

a lubricant-guiding cartridge disposed within said mandrel shaft bore, said cartridge having a longitudinal conduit defined in and through said cartridge and a peripheral wall having a circumferentially annular transverse groove defined in said peripheral wall in fluid communication with said longitudinal conduit for lubricant flow from said conduit to said annular groove, said annular groove being further defined in fluid communication with said channel in said shaft for lubricant flow from said annular groove to said lubrication point through said channel; and a central lubricant distribution unit at an end of said shaft proximate said cartridge and in fluid communication with said longitudinal conduit of said cartridge for centrally distributing lubricant from said unit through said conduit to said lubrication point.

5. The centrally-lubricating expanding reel mandrel of claim 4, wherein said peripheral wall of said cartridge further defines a second annular transverse groove disposed adjacent said annular groove, further comprising sealing means disposed along and between edges of said adjacent annular grooves for sealing engagement with said inner wall of said shaft so as to prevent cross-flow of lubricant between said adjacent annular grooves.

* * * * *